US006226822B1

(12) United States Patent
Chen

(10) Patent No.: US 6,226,822 B1
(45) Date of Patent: May 8, 2001

(54) TOOL STRUCTURE

(76) Inventor: Jin-Fu Chen, P.O. Box 2103, Taichung (TW)

( * ) Notice: Subject to any disclaimer, the term of this patent is extended or adjusted under 35 U.S.C. 154(b) by 0 days.

(21) Appl. No.: 09/425,183

(22) Filed: Oct. 25, 1999

(51) Int. Cl.[7] ..... B25B 7/22
(52) U.S. Cl. ..... 7/128; 7/167; 7/168; 30/260; 81/416
(58) Field of Search ..... 7/127–131, 125, 7/167–168; 81/415–416, 427.5; 30/260, 236

(56) References Cited

U.S. PATENT DOCUMENTS 6,023,805 * 2/2000 Lin ..... 7/128
6,070,504 * 10/2000 Frazer ..... 81/427.5
6,128,943 * 10/2000 Lemmens ..... 81/416
6,131,495 * 10/2000 Chen ..... 81/423

* cited by examiner

*Primary Examiner*—James G. Smith
*Assistant Examiner*—Lee Wilson

(57) ABSTRACT

A tool structure including two grips and a tool head. By way of an opening of a first pivot section of the grip, the first pivot sections of the grips can be separated, permitting the grips to be folded to two sides of the tool head. This reduces the room occupied by the tool and facilitates storage and carriage of the tool. The first pivot sections of the grips are spaced from the second pivot sections of the tool head by a certain distance to form a double-lever structure and prolong the length of the force application arm so as to save strength.

15 Claims, 10 Drawing Sheets

TOOL STRUCTURE

BACKGROUND OF THE INVENTION

The present invention relates to an improved tool structure, and more particularly to a tool structure having double-lever structure and can be folded to reduce occupied room.

FIG. 10 shows an existent tool having two grips 8 and a tool head 81. The front ends of the two grips 8 are pivotally connected with the tool head 81. The bottom ends of the grips 8 are pivotally connected with various kinds of tools with multiple usage such as a blade 82, a screwdriver, etc. which can be turned outward for use. The two grips 8 can be folded in reverse directions toward the end of the tool head 81 as shown in FIG. 11 so as to shorten the total length of the tool and reduce storage room of the tool as well as facilitate carriage of the tool.

However, in use of such tool, only the grip 8 provides a length of the force application arm so that the strength cannot be effectively saved to facilitate use of the tool.

FIG. 12 shows another type of existent tool which has double-lever structure. The tool also has two grips 9 and a tool head 91. The front ends of the two grips 9 are pivotally connected with the tool head 91. In addition, the two grips 9 are further pivotally connected with a pivot section 92 spaced from the pivot section 911 of the tool head 91 by a certain distance. By means of the double-lever structure between the grips 9 and the tool head 91, the strength for operation of the tool can be saved.

However, in such tool, the end of the tool head 91 is disposed with a pivot section 911 and the ends of the grips 9 are disposed with another pivot section 92. Moreover, the pivot sections 911, 92 must be respectively spaced from the end section 921 by a certain distance so as to save strength. Therefore, the total length of the tool is considerably long and the tool will occupy quite large room. As a result, it is inconvenient to store or carry the tool.

SUMMARY OF THE INVENTION

It is therefore a primary object of the present invention to provide a tool structure having double-lever structure. By means of an opening of a first pivot section of the grip, the first pivot sections of the grips can be separated, permitting the grips to be folded to two sides of the tool head. This reduces the room occupied by the tool and facilitates storage and carriage of the tool. Also, the tool can be operated with strength saved.

It is a further object of the present invention to provide the above tool structure in which the grips are equipped with multiple tools with various usage to meet the requirements in different fields.

According to the above objects, the tool structure of the present invention includes a tool head and two grips. The tool head is composed of two clamping members respectively disposed with two second pivot sections which are pivotally connected with each other by a second pivot shaft. The lower ends of the clamping members are respectively formed with two fixing holes.

Each of the grips is disposed with a first pivot section. The first pivot section of one grip is disposed with a first pivot shaft. The first pivot section of the other grip is disposed with a pivot hole. The grips are pivotally connected with each other via the first pivot sections. The first pivot sections of the grips are spaced from the second pivot section of the tool head by a certain distance. The grips are respectively formed with two fixing holes. A fixing pin is passed through the fixing holes of the tool head and the grips to fix the same. The pivot hole of the grip is formed with an opening, whereby the first pivot shaft of the other grip can be detached from the opening so as to separate the first pivot sections of the two grips from each other.

The present invention can be best understood through the following description and accompanying drawings wherein:

DETAILED DESCRIPTION OF THE PREFERRED EMBODIMENTS

Figure 1:
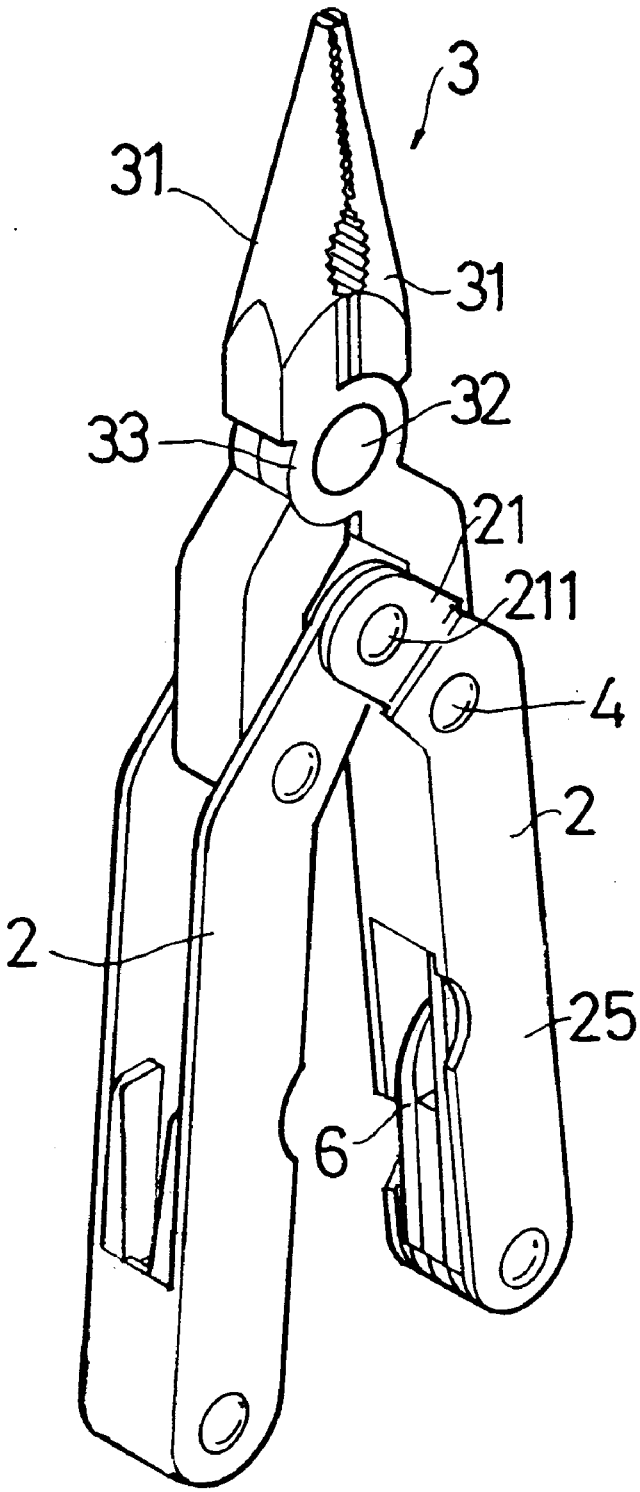
FIG. 1 is a perspective view of a first embodiment of the present invention.

Please refer to FIGS. 1 to 4. According to a first embodiment, the tool structure of the present invention includes:

a tool head 3 which is a pincers in this embodiment, the tool head 3 being composed of two clamping members 31, the clamping members 31 being respectively disposed with two second pivot sections 33 which are pivotally connected with each other by a second pivot shaft 32, the lower ends of the clamping members 31 being respectively formed with two fixing holes 34; and two elongated grips 2, the top end of each of the grips 2 being disposed with a first pivot section 21, the first pivot section 21 of one grip 2 being disposed with a first pivot shaft 211, the first pivot section 21 of the other grip 2 being disposed with a pivot hole 212, the grips 2 being pivotally connected with each other via the first pivot sections 21, the lower ends of the first pivot sections 21 being respectively formed with two fixing holes 22, a fixing pin 4 being passed through the fixing holes 34, 22 of the tool head 3 and grips 2 to fix the same, the fixing pin 4 being directed in parallel to the first pivot shaft 211, the first pivot section 21 of the grip 2 being spaced from the second pivot section 33 of the tool head 3 by a certain distance, the bottom end of the grip 2 being pivotally connected with multiple tools 6 such as a blade 63, screwdriver 64, etc.

The first pivot shaft 211 has a longer section 213 and a shorter section 214. The longer section 213 has a first length D1, while the shorter section 214 has a second length D2.

The first length D1 is longer than the second length D2. The pivot hole 212 of the first pivot section 21 of the grip 2 is formed with an opening 27. The opening 27 has a width smaller than the diameter of the pivot hole 212 and the first length D1 of the first pivot shaft 211, while larger than the second length D2 of the first pivot shaft 211.

Figure 2:
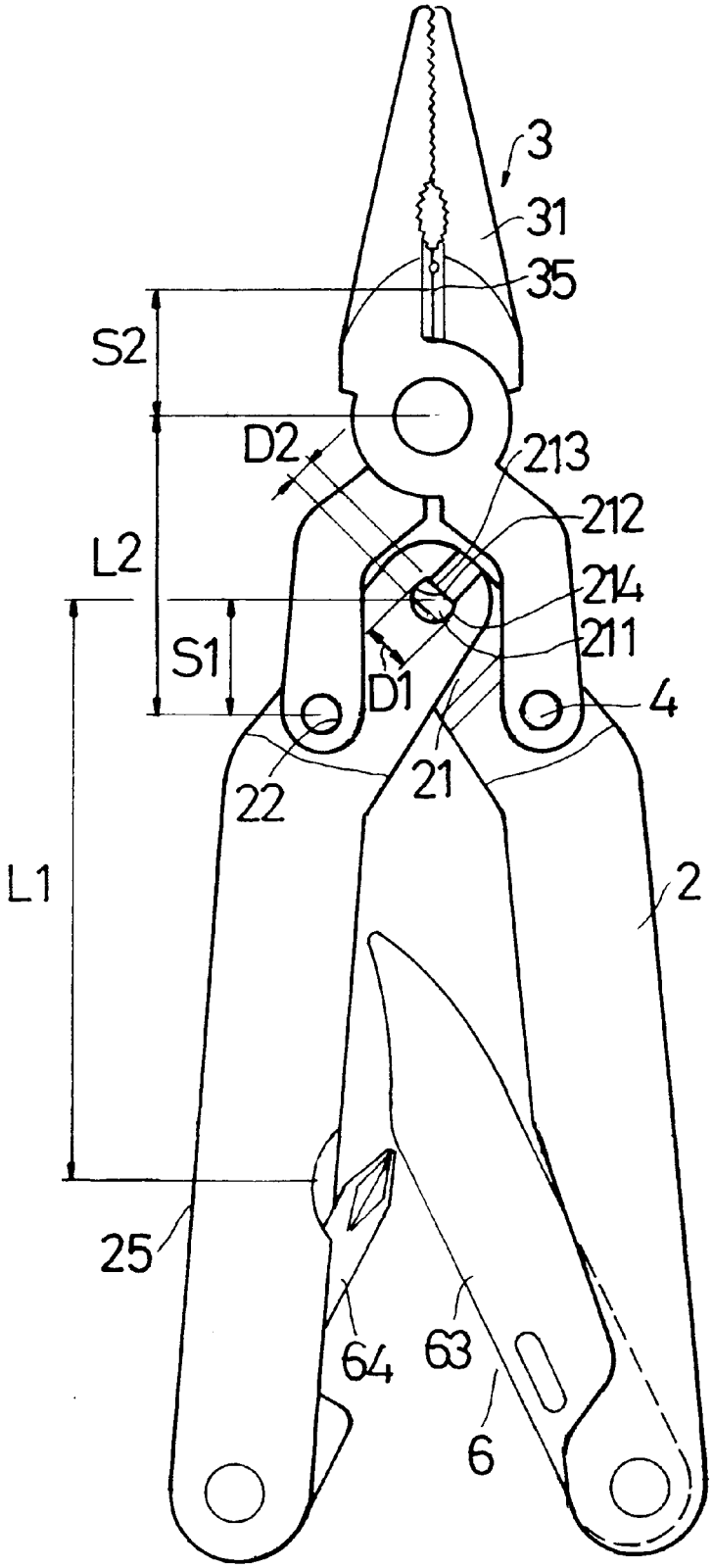
FIG. 2 is a plane view showing the tools and force arms of the first embodiment of the present invention.

As shown in FIG. 2, the first pivot section 21 of the grip 2 is spaced from the second pivot section 33 of the tool head 3 by a certain distance. The length from the pivot center of the first pivot section 21 of the grip 2 to the force application section 25 of the grip 2 defines a first force application arm L1. The length from the pivot center of the first pivot section 21 of the grip 2 to the center of the fixing hole 22 defines a first force resistant arm S1. The length from the pivot center of the second pivot section 33 of the tool head 3 to the center of the fixing hole 34 defines a second force application arm L2. The length from the pivot center of the second pivot section 33 of the tool head 3 to the working section 35 of the tool head 3 defines a second force resistant arm S2. The lengths of the first and second force application arms L1, L2 are longer than the lengths of the first and second force resistant arms S1, S2. When applying a force to the grips 2, the length of the force application arm is the total of the lengths of the first and second force application arms L1, L2. Therefore, by means of the double-lever structure between the grips 2 and the tool head 3, the strength can be saved.

Figure 3:
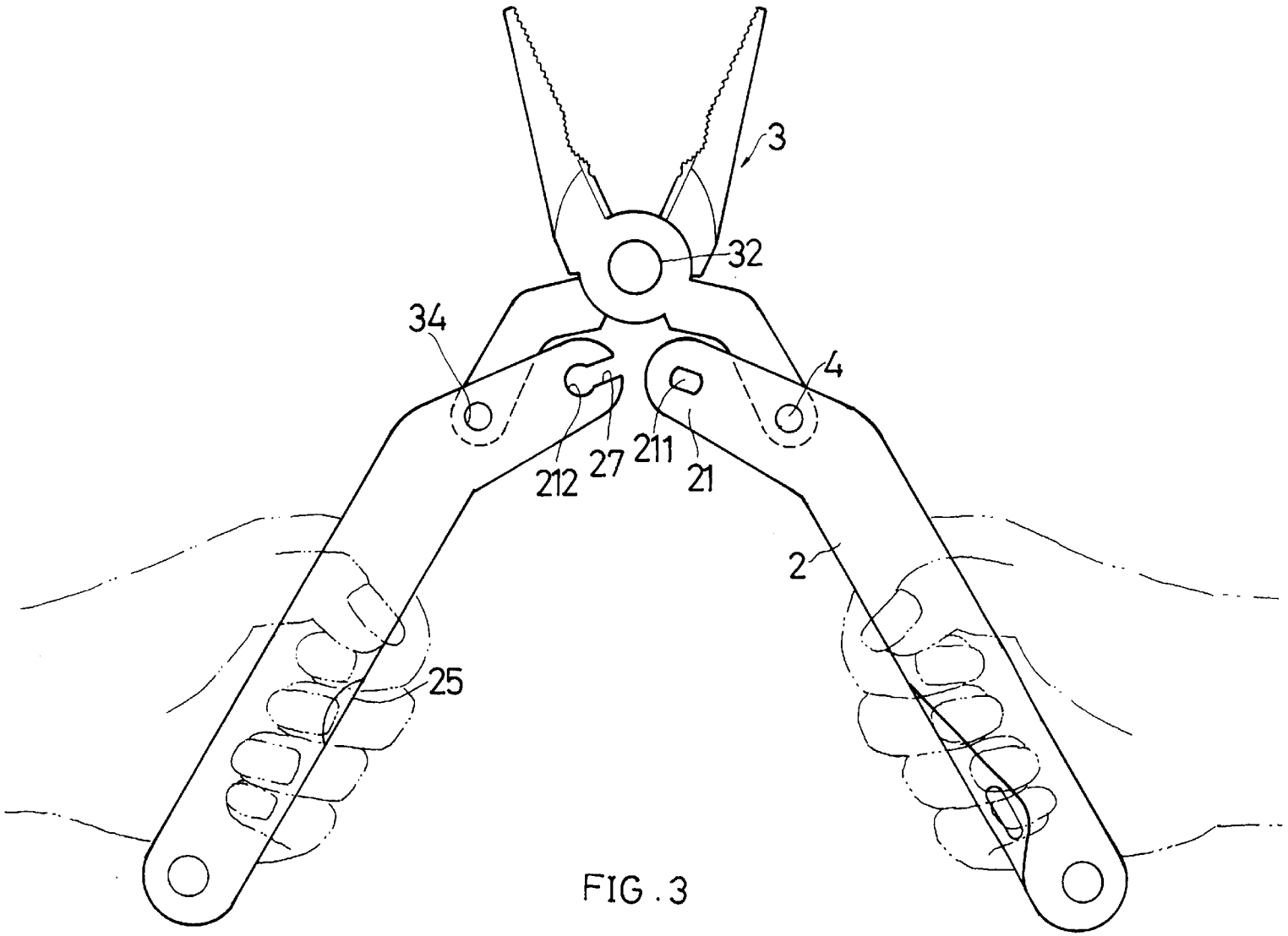
FIG. 3 shows that the grips of the first embodiment of the present invention are separated from each other.
Figure 4:
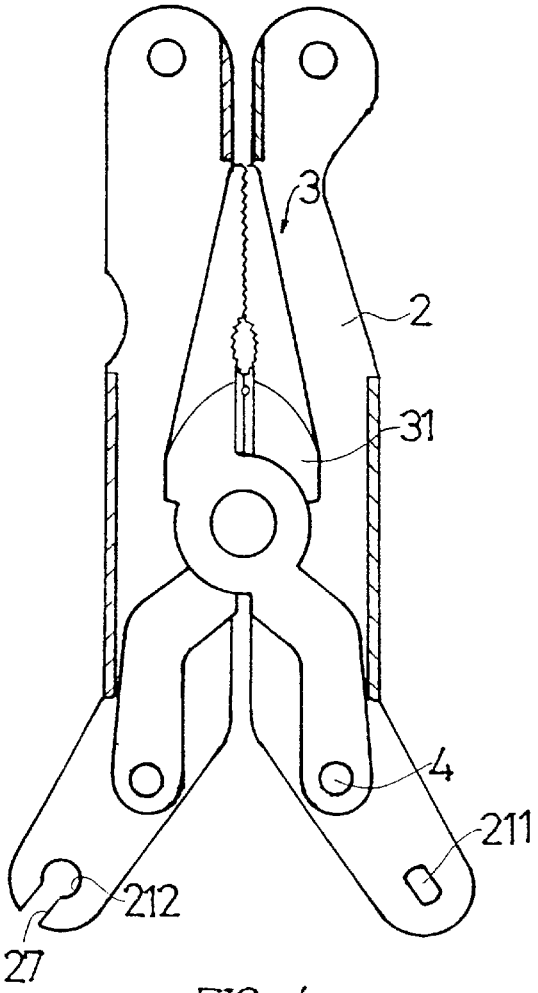
FIG. 4 shows that the tool of the first embodiment of the present invention is folded.

When folding the tool, as shown in FIGS. 3 and 4, the opening 27 is formed on one side of the grip 2 opposite to the other grip 2 so that the two grips 2 can be pulled open by different angles to make the opening 27 aligned with the shorter section 214 of the first pivot shaft 211. That is, the two grips 2 are such opened that the first pivot shaft 211 can be detached from the opening 27 and folded along two sides thereof to the end of the tool head 3. Therefore, the tool can be easily folded. Reversely, in use, the two grips 2 are bent downward and the first pivot shaft 211 is aimed at the opening 27 and fitted thereinto for use of the tool. The force of working will press the grips 2 inward so that the first pivot shaft 211 is prevented from detaching from the opening 27. Therefore, the working will not be affected. Accordingly, when using the tool, it is unnecessary to switch any button so that the use of the tool is facilitated. After folded, the room occupied by the tool is reduced so that it is easy to store and carry the tool.

In addition, the bottom ends of the grips 2 are pivotally connected with tools 6 such as blade 63 and screwdriver head 64 which can be turned outward for use. The tools serve to provide multiple usage in various fields.

Alternatively, the grips 2 can be equipped with a ratchet wrench, knife or other tools without limitation.

Figure 5:
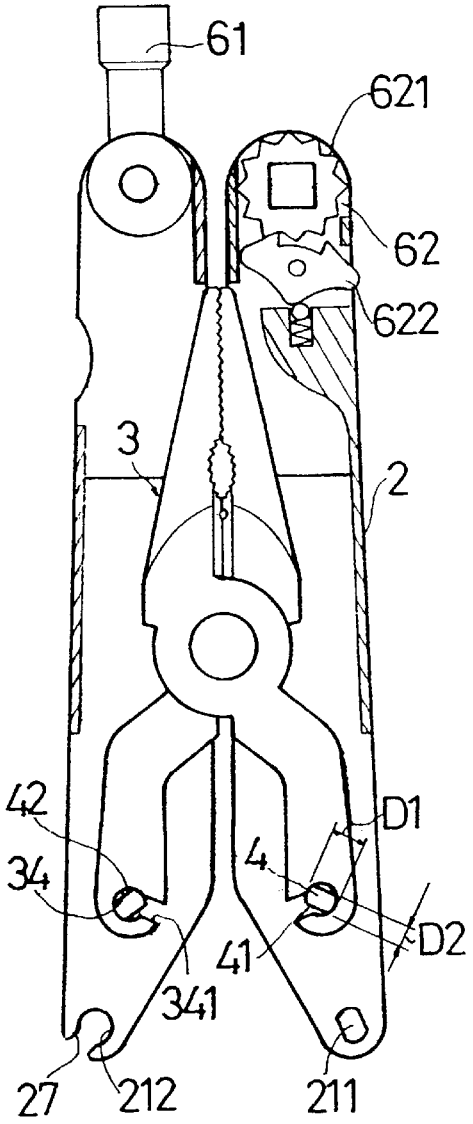
FIG. 5 shows the tools of the second embodiment of the present invention.
Figure 6:
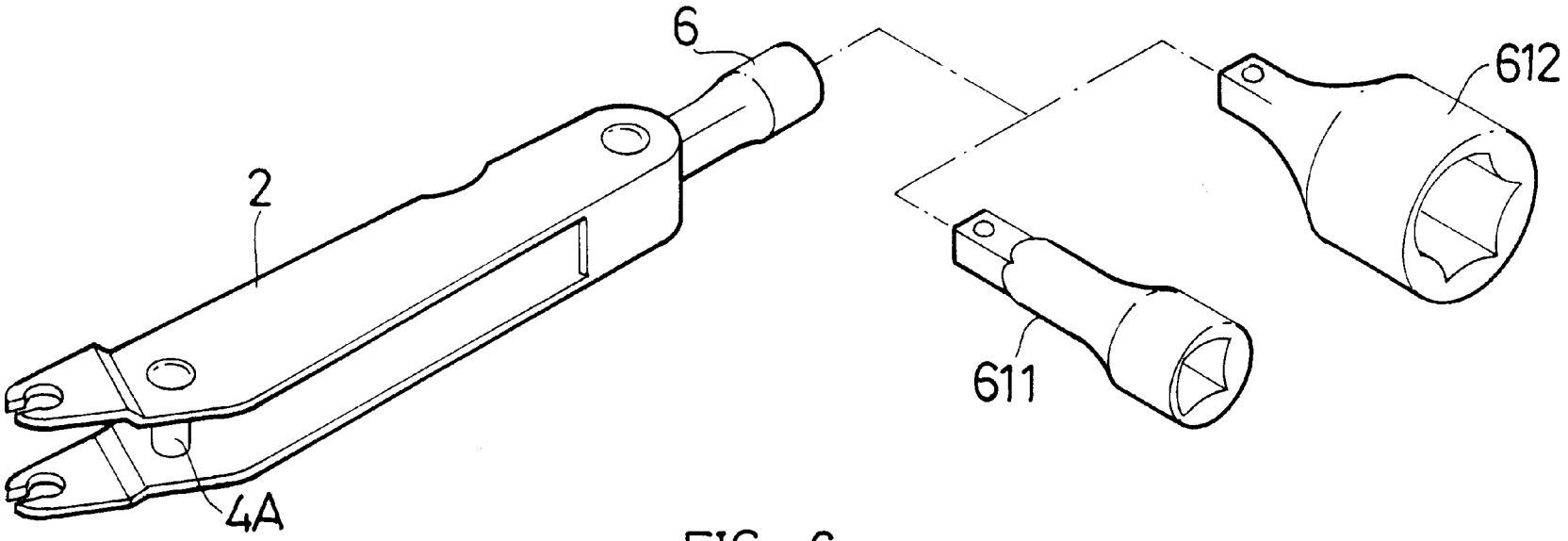
FIG. 6 shows the use of the grip of the second embodiment of the present invention.

As shown in FIGS. 5 and 6, according to a second embodiment of the present invention, the fixing pin 4 of the grips 2 similarly has a longer section 41 and a shorter section 42. The fixing holes 34 of the clamping members 3 of the tool head 3 are respectively formed with two openings 341. The width of the openings 341 is smaller than the diameter of the fixing hole 34 and first length D1 of the longer section 41 of the fixing pin 4, while larger than the second length D2 of the shorter section 42 of the fixing pin 4. The grip 2 is pivotally disposed with a socket 61 which can be fitted with other socket or screwdriver connecting rod (not shown). The other grip 2 is disposed with a ratchet wrench 62 having a ratchet 621 clamped by clamping boards of the grip 2. The ratchet 621 is disposed with a switch mechanism 622, whereby the ratchet 621 can be only one-way rotated. Therefore, in addition to installation of the above blade 63 and screwdriver head 24, by means of the openings 27, the grips of the tool of the present invention equipped with the socket 61 and ratchet wrench 62 can be taken off for use. The socket 61 can be fitted with other sockets 611, 612 or screwdriver connecting rod (not shown ) so that one single grip 2 can be held and used without holding the other grip 2 and the tool head 3.

Figure 7:
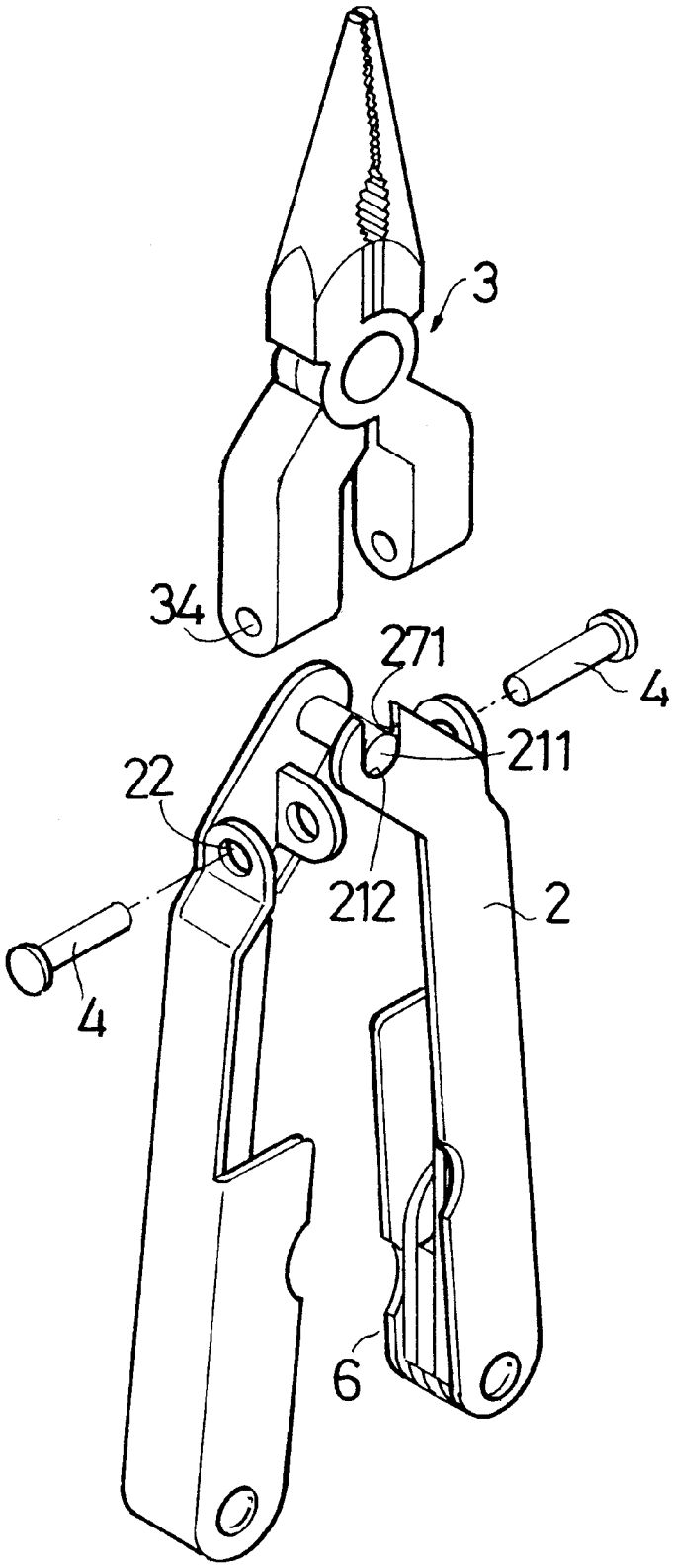
FIG. 7 is a perspective exploded view of a third embodiment of the present invention.
Figure 8:
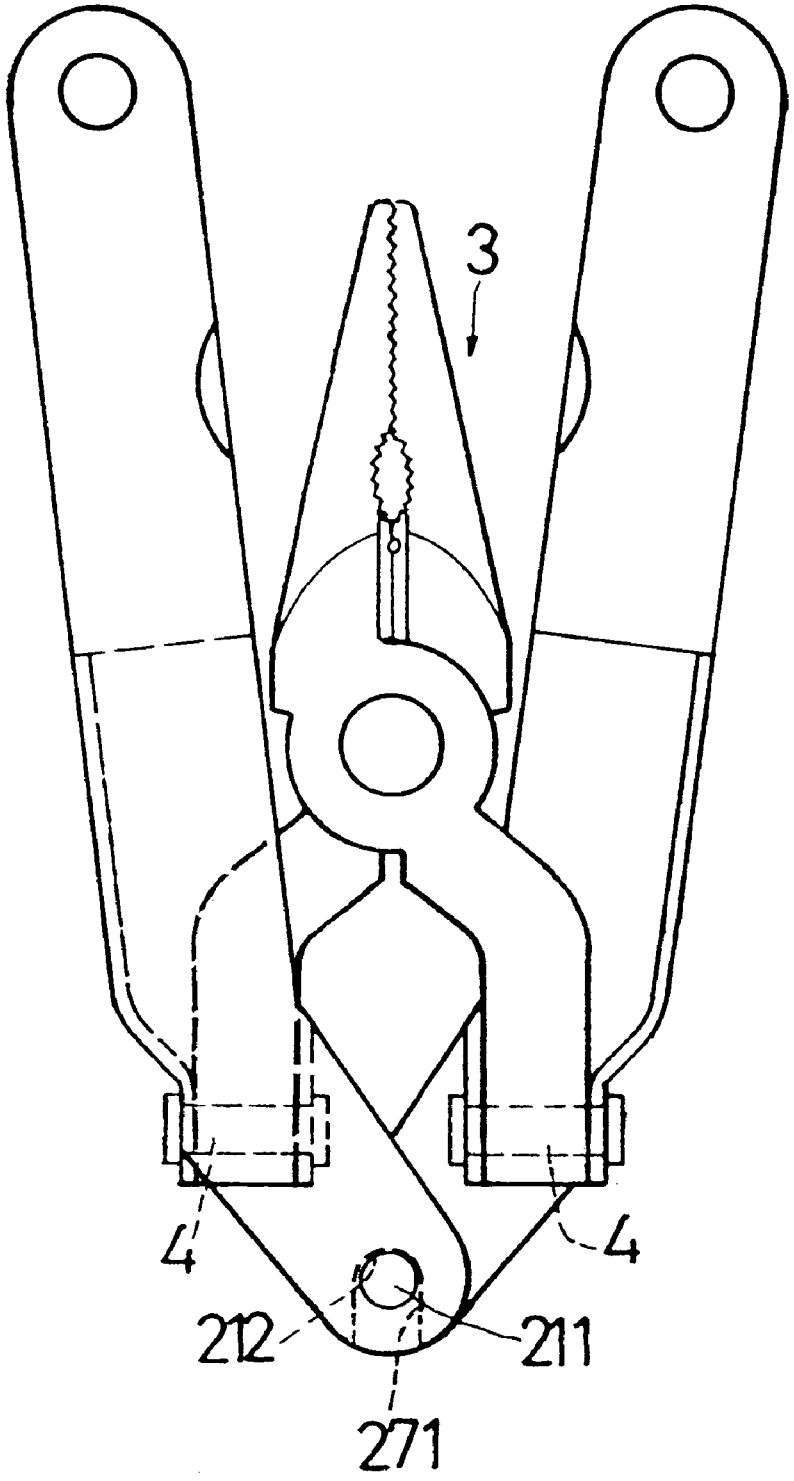
FIG. 8 is a plane view showing the folding of the third embodiment of the present invention.

FIGS. 7 and 8 show a third embodiment of the present invention, in which the two grips 2 are symmetrically arranged. One of the grips 2 is disposed with a first pivot shaft 211, while the other grip 2 is formed with a pivot hole 212. The pivot hole 212 is formed with an opening 271. The width of the opening 271 is approximate to the diameter of the first pivot shaft 211. The direction of the fixing pin 4 of the grip 2 is perpendicular to the first pivot shaft 211.

By means of the opening 271, the grip 2 can be folded to a front side of the tool head 3, while the other grip 2 can be folded to a rear side of the tool head 3 as shown in FIG. 8. Similarly, the room occupied by the tool is reduced to facilitate storage and carriage of the tool.

Figure 9:
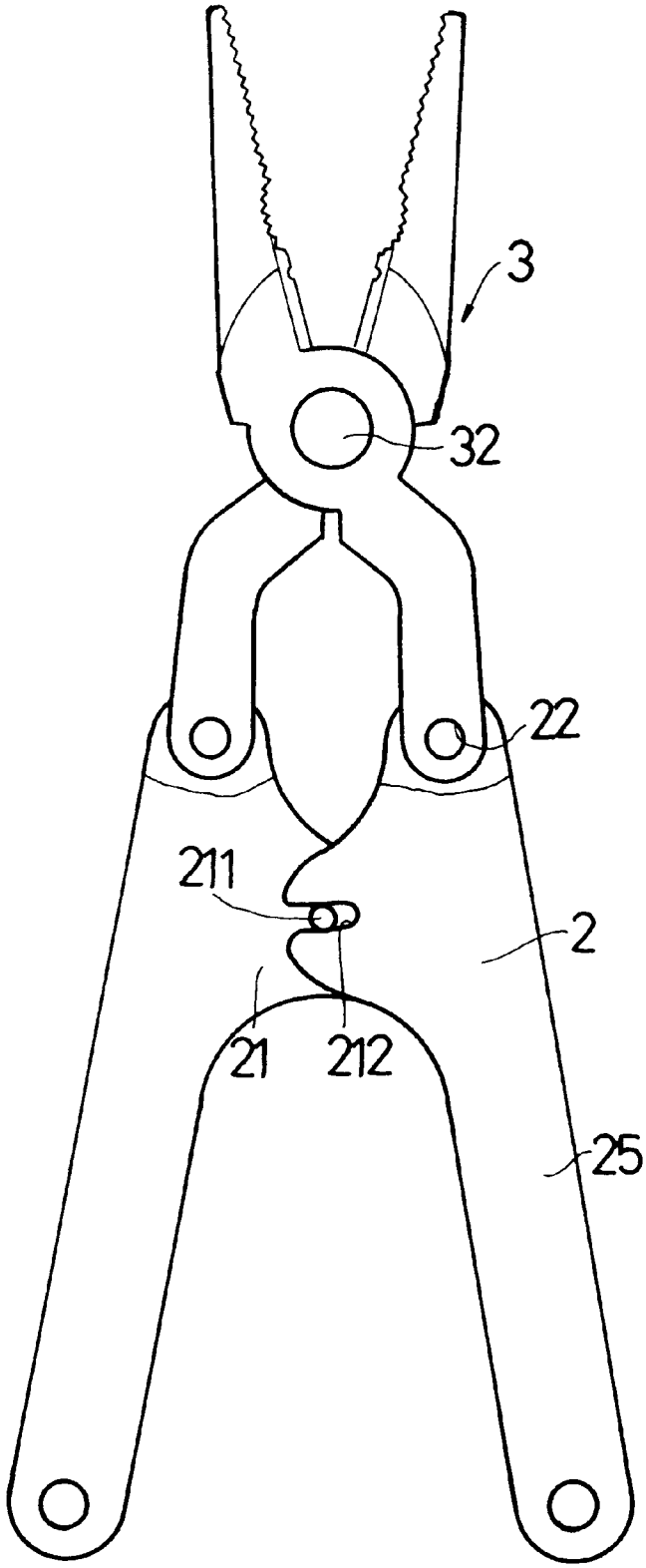
FIG. 9 is a plane view of a fourth embodiment of the present invention.
Figure 10:
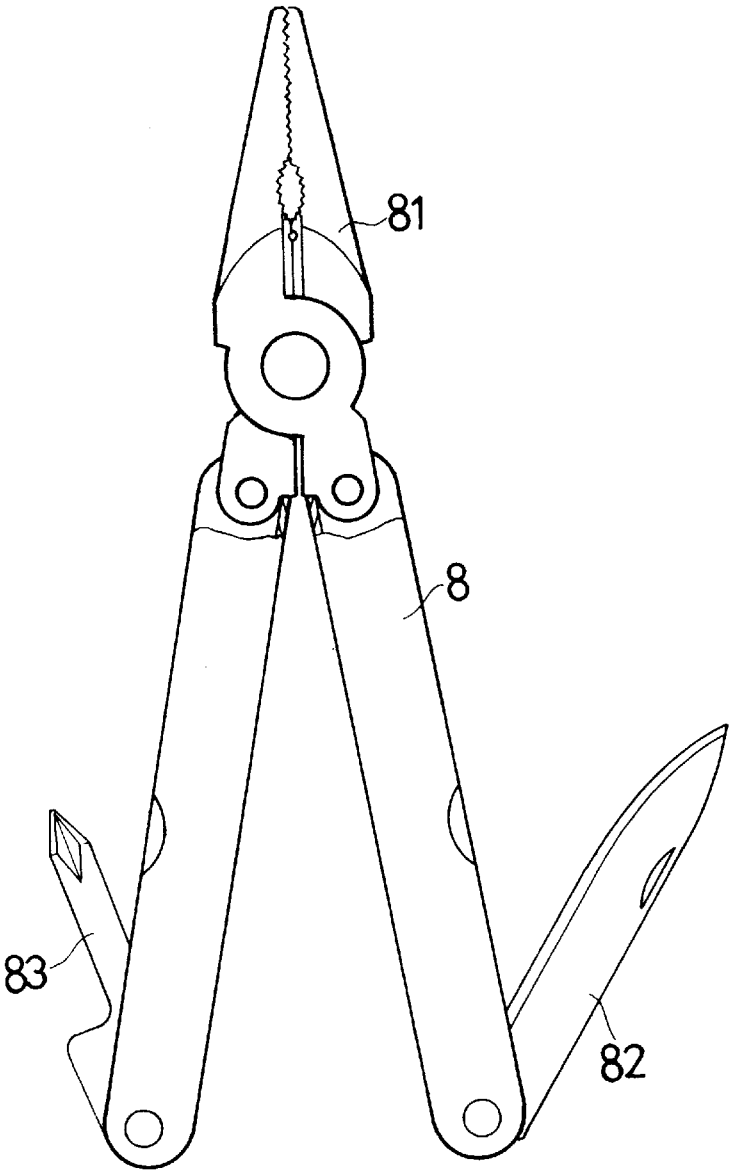
FIG. 10 PRIOR ART
FIG. 10 shows a first conventional tool.
Figure 11:
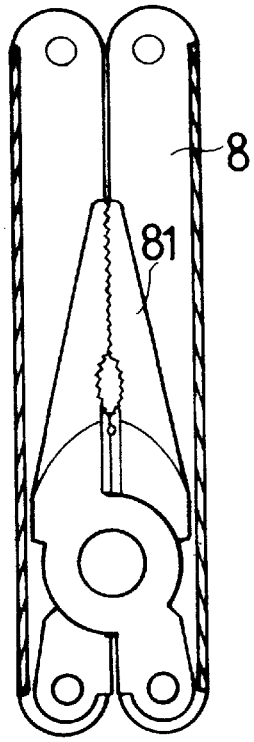
FIG. 11 PRIOR ART
FIG. 11 shows that the conventional tool of FIG. 10 is folded.
Figure 12:
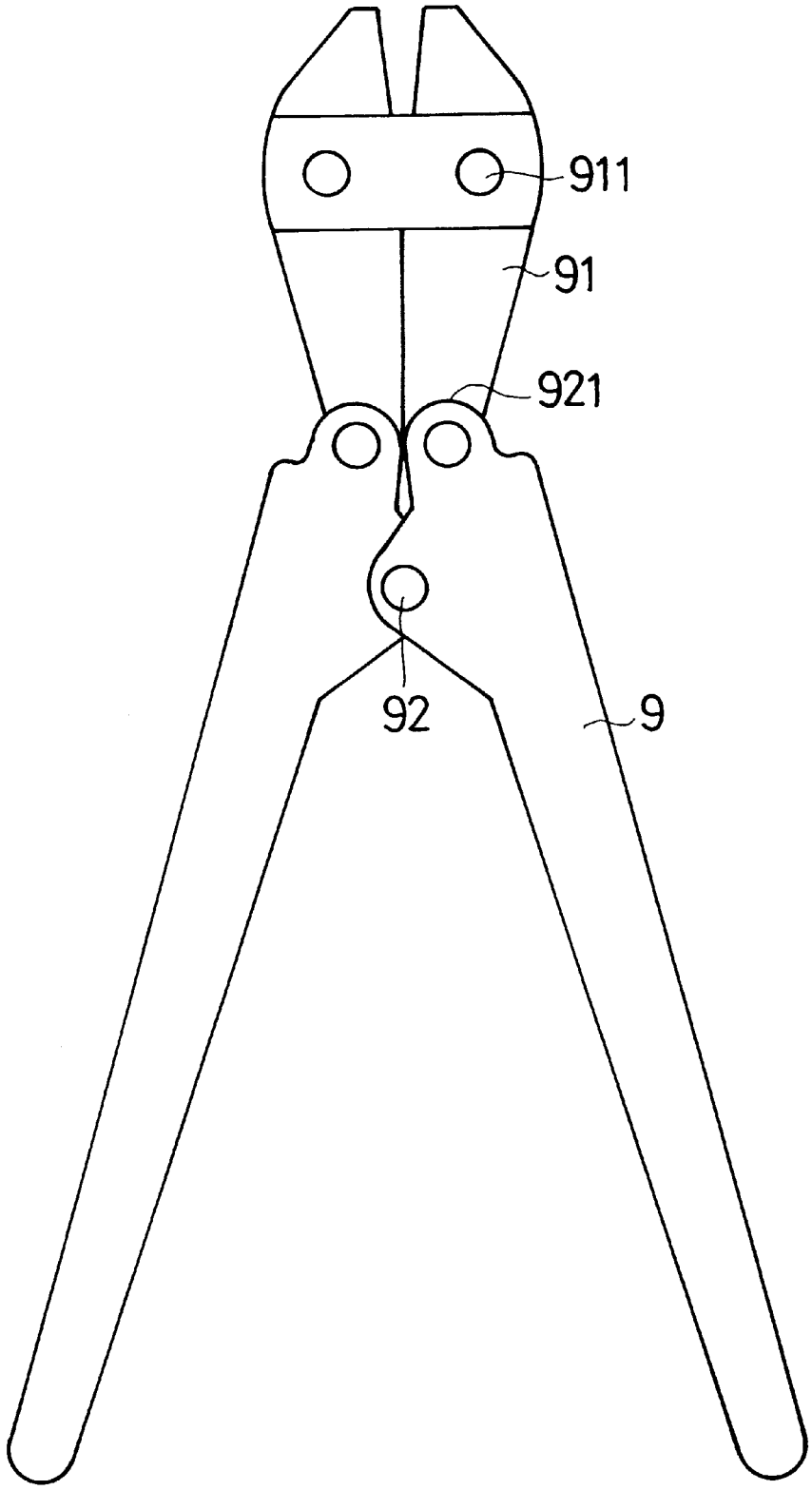
FIG. 12 PRIOR ART
FIG. 12 is a plane view of a second conventional tool.

FIG. 9 shows a fourth embodiment of the present invention, in which the fixing hole 22 and force application section 25 of the grip 2 are positioned on top and bottom sides of the first pivot sections 21 of the grips 2. This embodiment also provides multiple tools with various usage and saves strength.

In conclusion, by means of the opening 27 of the first pivot section 21 of the grip 2, the first pivot sections 21 of the grips 2 can be separated, permitting the grips 2 to be folded to the tool head 3. This reduces the room occupied by the tool and facilitates storage and carriage of the tool. The grips 2 are equipped with multiple tools 6 with various usage to meet the requirements in different fields. In addition, the first pivot sections 21 of the grips 2 are spaced from the second pivot sections 33 of the tool head 3 by a certain distance to form a double-lever structure and prolong the length of the force application arm so as to save strength.

The above embodiments are only used to illustrate the present invention, not intended to limit the scope thereof. Many modifications of the above embodiments can be made without departing from the spirit of the present invention.

What is claimed is:

1. A tool structure comprising:

a tool head composed of two clamping members, the clamping members being respectively disposed with two second pivot sections which are pivotally connected with each other by a second pivot shaft, lower ends of the clamping members being respectively formed with two fixing holes; and two grips, each of the grips being disposed with a first pivot section, the first pivot section of one grip being disposed with a first pivot shaft, the first pivot section of the other grip being disposed with a pivot hole, the grips being pivotally connected with each other via the first pivot sections, the first pivot sections of the grips being spaced from the second pivot section of the tool head by a certain distance, the grips being respectively formed with two fixing holes, a fixing pin being passed through the fixing holes of the tool head and the grips to fix the same, said tool structure being characterized in that the pivot hole of the grip is formed with an opening, whereby the first pivot shaft of the other grip can be detached from the opening so as to separate the first pivot sections of the two grips.

2. A tool structure as claimed in claim 1, wherein the grips are equipped with multiple tools with various usage.

3. A tool structure as claimed in claim 2, wherein the tools include a screwdriver head pivotally connected with the grip.

4. A tool structure as claimed in claim 2, wherein the tools include a socket pivotally connected with the grip.

5. A tool structure as claimed in claim 2, wherein the tools include a ratchet wrench having a ratchet disposed between two clamping boards of the grip.

6. A tool structure as claimed in claim 2, wherein the tools include a blade pivotally connected with the grip.

7. A tool structure as claimed in claim 1, wherein the first pivot shaft has a longer section and a shorter section, the longer section having a first length, the shorter section having a second length, the first length being longer than the second length.

8. A tool structure as claimed in claim 7, wherein the width of the opening is smaller than the first length, while larger than the second length.

9. A tool structure as claimed in claim 1, wherein the width of the opening of the grip is approximate to the diameter of the first pivot shaft.

10. A tool structure as claimed in claim 1, wherein the fixing pin of the grip is disposed in a direction parallel to the first pivot shaft.

11. A tool structure as claimed in claim 1, wherein the fixing pin of the grip is disposed in a direction perpendicular to the first pivot shaft.

12. A tool structure as claimed in claim 1, wherein the fixing hole of the tool head is formed with an opening, permitting the tool head to be separated from the grips.

13. A tool structure as claimed in claim 12, wherein the fixing pin of the grip has a longer section and a shorter section, the longer section having a first length, the shorter section having a second length, the first length being longer than the second length.

14. A tool structure as claimed in claim 1, wherein the fixing hole and force application section of the grips are positioned on two sides of the pivot sections of the grips.

15. A tool structure as claimed in claim 1, wherein the fixing hole and force application section of the grips are positioned on one side of the pivot sections of the grips.

* * * * *